US012130103B2

(12) United States Patent
Špine

(10) Patent No.: US 12,130,103 B2
(45) Date of Patent: Oct. 29, 2024

(54) MANUAL THUMB SAFETY

(71) Applicant: HS Produkt D.O.O., Karlovac (HR)

(72) Inventor: Marijo Špine, Karlovac (HR)

(73) Assignee: HS Produkt D.O.O., Karlovac (HR)

( * ) Notice: Subject to any disclaimer, the term of this patent is extended or adjusted under 35 U.S.C. 154(b) by 0 days.

(21) Appl. No.: 18/171,920

(22) Filed: Feb. 21, 2023

(65) Prior Publication Data

US 2023/0266087 A1 Aug. 24, 2023

Related U.S. Application Data

(60) Provisional application No. 63/312,560, filed on Feb. 22, 2022.

(51) Int. Cl.
*F41A 17/52* (2006.01)
*F41A 19/10* (2006.01)

(52) U.S. Cl.
CPC ..... *F41A 17/52* (2013.01); *F41A 19/10* (2013.01)

(58) Field of Classification Search
CPC ..... F41A 17/22; F41A 17/28; F41A 17/30; F41A 17/32; F41A 17/42; F41A 17/46; F41A 17/56
USPC ..... 42/70.01, 70.04, 70.05, 70.06; 89/142, 89/148, 27.12
See application file for complete search history.

(56) References Cited

U.S. PATENT DOCUMENTS 3,442,173 A * 5/1969 Muller ..... F41A 19/21 42/105
4,414,769 A * 11/1983 Mueschke ..... F41A 17/00 42/70.01
4,726,136 A * 2/1988 Dornaus ..... F41A 17/64 42/70.08
5,251,394 A * 10/1993 Bornancini ..... F41A 17/56 42/70.08
5,303,494 A * 4/1994 Tuma ..... F41A 17/74 42/70.04
6,560,909 B2 5/2003 Cominolli
7,204,051 B2 4/2007 Thomele et al.
7,234,261 B2 6/2007 McGarry
7,690,144 B2 4/2010 Fagundes de Campos
7,810,269 B2 10/2010 Zukowski et al.
8,033,043 B2 10/2011 McGarry
8,127,481 B2 3/2012 Rozum et al.
8,499,482 B1 8/2013 Di Trolio
8,528,242 B2 9/2013 Green
(Continued)

*Primary Examiner* — Bret Hayes
(74) *Attorney, Agent, or Firm* — Woodard, Emhardt, Henry, Reeves & Wagner, LLP

(57) ABSTRACT

A firearm includes a manual safety assembly. The manual safety assembly includes a first manual safety lever that is removably attachable to a second manual safety lever. Each of the manual safety levers includes a lever portion and a connection portion that extends transversely from the lever portion. A blocking lever extends from the connection portion of the first manual safety lever so that the blocking lever is substantially parallel to the first manual lever portion. The manual safety assembly is coupled to the firearm so that the manual safety assembly may be configured in an engaged position in which the blocking lever inhibits movement of a trigger bar of the firearm to prevent the firearm from firing. The manual safety assembly may be moved into a disengaged position that allows movement of the trigger bar.

20 Claims, 10 Drawing Sheets

(56) References Cited

U.S. PATENT DOCUMENTS

| | | | | |
|---|---|---|---|---|
| 9,222,745 | B2 | 12/2015 | Kallio | |
| 9,383,153 | B2 | 7/2016 | Nebeker et al. | |
| 9,557,128 | B2 | 1/2017 | Miller, III | |
| 9,568,262 | B2 | 2/2017 | Bantle et al. | |
| RE46,411 | E | 5/2017 | Chu | |
| 9,823,032 | B2 | 11/2017 | Allan | |
| 9,970,726 | B1 | 5/2018 | Hubert et al. | |
| 10,030,926 | B2 | 7/2018 | Mather et al. | |
| 10,378,847 | B2 | 8/2019 | Folk et al. | |
| 10,859,334 | B2 | 12/2020 | Gant et al. | |
| 2013/0152444 | A1* | 6/2013 | Tatum | F41A 17/56<br>42/70.01 |
| 2019/0195587 | A1* | 6/2019 | Thomele | F41A 11/00 |
| 2019/0285373 | A1* | 9/2019 | Palkow | F41A 19/16 |
| 2019/0301824 | A1* | 10/2019 | Maeda | F41A 17/56 |
| 2019/0390928 | A1 | 12/2019 | Curry | |
| 2021/0247157 | A1* | 8/2021 | Lesenfants | F41A 19/44 |

* cited by examiner

MANUAL THUMB SAFETY

BACKGROUND OF THE INVENTION

The present invention pertains generally to safety assemblies for firearms. In particular, the present disclosure is applicable to manual safeties.

To protect against an unintentional discharge of a firearm, firearm and trigger manufacturers have designed and implemented various safety mechanisms. There remains, however, a desire for new and improved safety mechanisms.

SUMMARY OF THE INVENTION

A manual safety assembly may include a first manual safety lever and a second manual safety lever. The first manual safety lever may include a first lever portion and a first connection portion that extends transversely from the first lever portion. The first manual safety lever may also include a blocking lever that extends from the first connection portion. The blocking lever may extend substantially parallel with respect to the first lever portion of the first manual safety lever.

The second manual safety lever may include a second lever portion and a second connection portion that extends transversely from the second lever portion. The first connection portion of the first manual safety lever may be connectable to the second connection portion of the first manual safety lever. A first connection opening may extend through the first connection portion and a corresponding second connection opening may extend through the second connection portion. A part of the first connection portion may be inserted into a part of the second connection portion so that the connection openings align. A manual safety connector may be inserted through the aligned connection openings to secure the first manual safety lever to the second manual safety lever.

The trigger assembly may include a trigger and a safety trigger to form a dual trigger arrangement. In other embodiments, the trigger assembly may only include a single trigger. The trigger may be operationally connected to the trigger bar. The trigger bar may extend reward with respect to the trigger. A trigger bar extension may extend substantially perpendicular from the trigger bar near the rearward end of the trigger bar.

The sear assembly may include a sear housing. The sear housing can include two parallel rails with an opening between the parallel rails that is sized so that the sear may fit between the rails. A sear spring may also fit into this opening and may be attachable to the sear. The sear housing may also define several openings so the other components may be connected to or extend through the sear housing. A trigger bar opening may be defined through a forward portion of the sear housing and can be configured to receive the trigger bar extension. A disconnector opening may be defined through a medial portion of the sear housing, and a manual safety opening may be defined through a rearward portion of the sear housing. A sear housing opening may be defined through a bottom portion of the sear housing.

A disconnector pin may be inserted through the disconnector opening in the sear housing. A disconnector spring may be positioned between the rails of the sear housing and surround at least a portion of the disconnector pin. An end of the disconnector pin may be connected to a disconnector which is positioned on the exterior of the sear housing. The sear assembly also may include a recess defined partially in a side wall of the sear housing. A manual safety positioner may be fit within the recess, and a manual safety spring may be attached to the sear housing at one end and the manual safety positioner at the other end to act as a bias for the manual safety positioner. The sear assembly may further include a sear housing pin that is configured to fit through the sear housing opening of the sear housing. A sear housing pin safety can fit around the sear housing pin.

The manual safety assembly may be supported by the sear housing and can be positioned rearward of the sear, disconnector, and disconnector spring. The first connection portion of the manual safety may extend through an opening defined in the sear housing and the second connection portion may extend through a corresponding opening defined through the opposing side of the sear housing. The first lever portion of the safety assembly may be positioned exterior of a side wall of the sear housing and the second lever portion may be positioned exterior to the opposite side wall of the sear housing.

The manual safety assembly can be arranged in an engaged configuration. In the engaged configuration, the first lever portion of the first manual safety lever may be arranged in a raised position. Additionally, the manual safety spring may bias the manual safety positioner so that the manual safety positioner contacts a bottom surface of the blocking lever. When arranged in this position, a portion of the blocking lever may be directly rearward of the trigger bar extension. Therefore, the blocking lever can prevent rearward of movement of the trigger bar and subsequent rotation of the sear that causes a slight rearward and downward movement of the top of the sear as the trigger of the firearm is pulled and the firearm cannot be fired.

The first manual safety lever may also be arranged in a lowered position so that the manual safety assembly is in a disengaged configuration. In the disengaged configuration, the blocking lever can also be pushed downward so that the manual safety positioner contacts a front edge of the blocking lever rather than the bottom surface.

The downward movement of the blocking lever may provide clearance for the trigger bar to move rearwardly and slightly downward when the trigger is pulled. Allowing rearward movement of the trigger bar allows the firearm to fire upon pulling trigger.

The manual safety assembly may be ambidextrous, so that a user may use either the first manual safety lever or the second manual safety lever to engage or disengage the manual safety assembly. To engage the manual safety assembly, a user may move either of the manual safety levers upward into the raised position. To disengage the manual safety assembly, the user may move either of the manual safety levers downward into the lowered position.

Further forms, objects, features, aspects, benefits, advantages, and embodiments of the present invention will become apparent from a detailed description and drawings provided herewith.

DESCRIPTION OF THE SELECTED EMBODIMENTS

Figure 1:
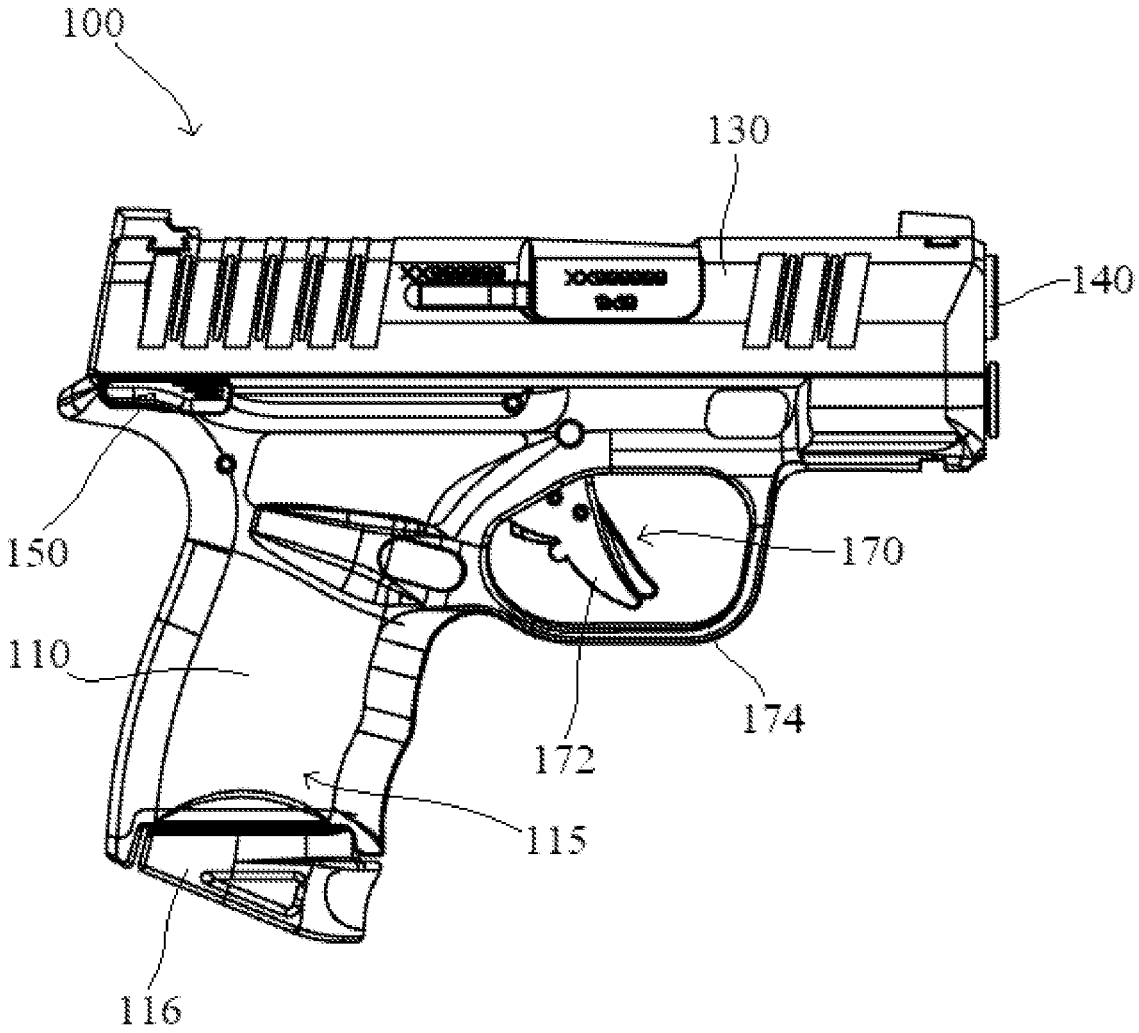
FIG. 1 is a side view of a firearm.

For the purpose of promoting an understanding of the principles of the invention, reference will now be made to the embodiments illustrated in the drawings and specific language will be used to describe the same. It will nevertheless be understood that no limitation of the scope of the invention is thereby intended. Any alterations and further modifications in the described embodiments, and any further applications of the principles of the invention as described herein are contemplated as would normally occur to one skilled in the art to which the invention relates. One embodiment of the invention is shown in great detail, although it will be apparent to those skilled in the relevant art that some features that are not relevant to the present invention may not be shown for the sake of clarity.

Directional terms, such as forward, rearward, top, bottom, etc., are used in this description with reference to the specific embodiment shown and used for purposes of clarity. It should be recognized that these terms are not meant to be limiting.

A side view of a firearm 100 is shown in FIG. 1. In the embodiment shown, the firearm 100 is a pistol. Firearm 100 includes a frame 110. The frame 110 defines a magazine well 115 for receiving a magazine 116. A slide 130 is positioned atop the frame 110 so that the slide 130 may move along the length of the frame 110. A barrel 140 is supported within the slide 130. The firearm 100 also includes a trigger assembly 170 that is housed within the frame 110. The trigger assembly 170 includes a trigger 172 that is protected by a trigger guard 174.

A manual safety assembly 150 is positioned between the frame 110 and the slide 130. The manual safety assembly 150 operates to prevent accidental firing of the firearm 100 when the manual safety assembly 150 is arranged in an engaged position. The manual safety assembly 150 is positioned so that the safety may be easily operated by the thumb of an operator of the firearm 100.

Figure 2:
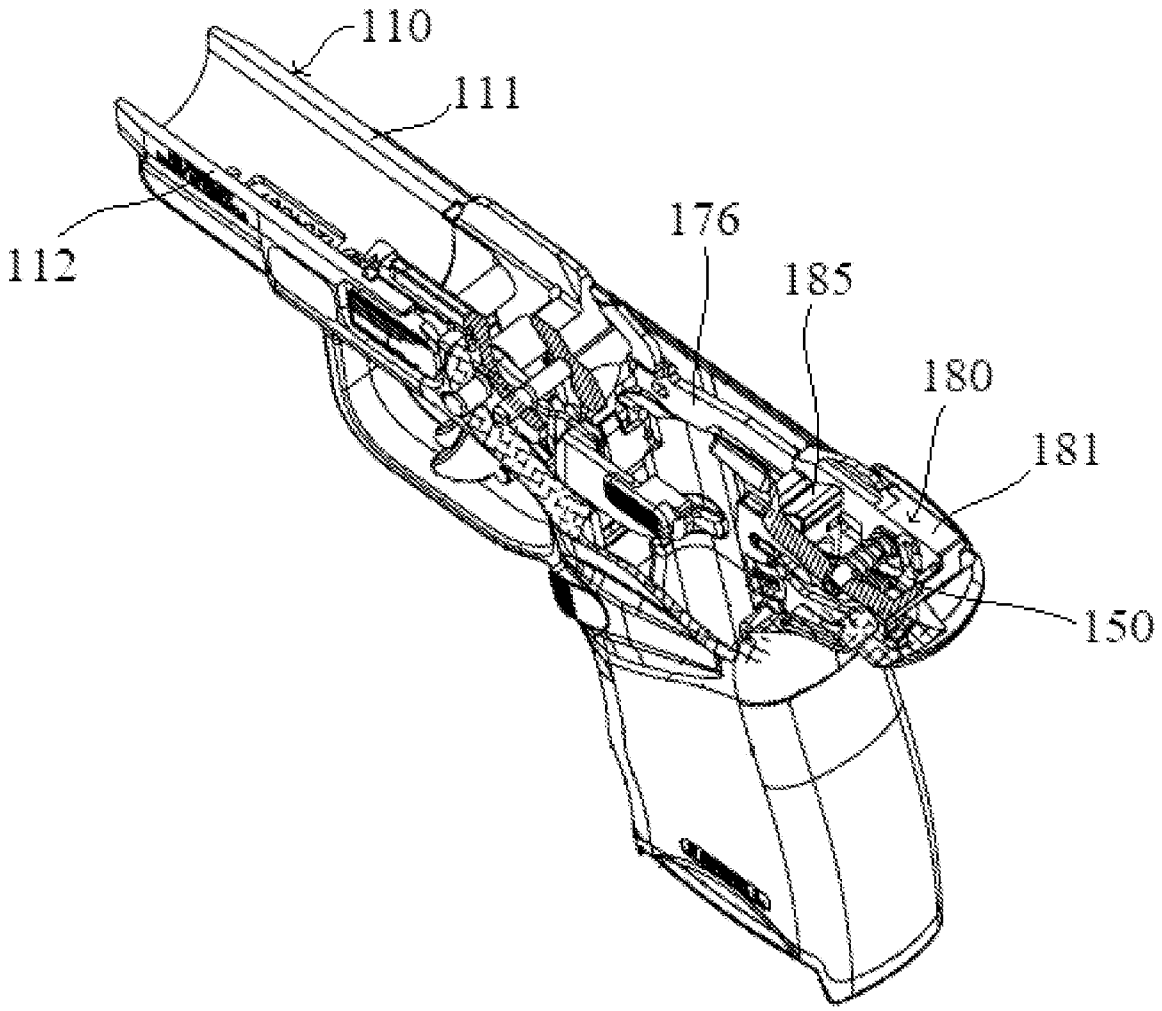
FIG. 2 is top perspective view of a frame of the firearm of FIG. 1 and components within the frame.

FIG. 2 illustrates a cutaway, top perspective view of the firearm 100. In this view, the slide 130 and the barrel 140 have been removed to provide a look at the interior of the firearm 100. The frame 110 includes two sidewalls 111, 112 that extend substantially parallel to each other and define a hollow frame interior that includes the trigger assembly and other components that are used to operate the firearm 100. In the view shown in FIG. 2, a portion of the sidewall 112 has been cutaway to better show the components within the interior of the frame 110.

As shown in FIG. 2, the trigger assembly 170 includes a trigger bar 176 that extends rearwardly, toward a sear 185 that is positioned within a sear housing 181. As shown, a portion of the trigger bar 176 runs substantially parallel to sidewall 111 of the frame 110. The manual safety assembly 150 is positioned rearward of the sear 185 and of the trigger bar 176 and spans between the sidewalls 111, 112 of the frame 110.

Figure 3:
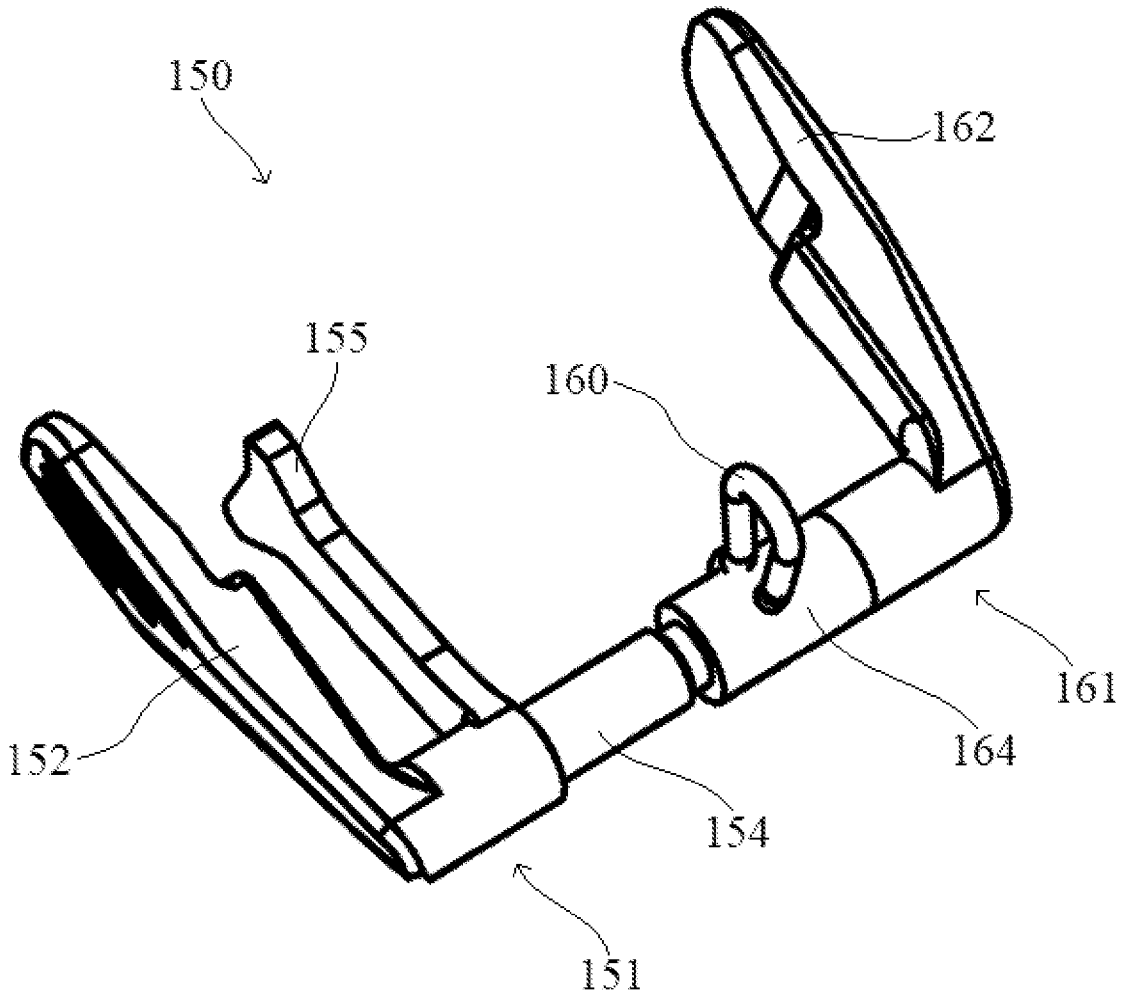
FIG. 3 is a perspective view of a manual safety assembly of the firearm of FIG. 1.

The manual safety assembly 150 is shown in FIG. 3. The manual safety assembly 150 includes a first manual safety lever 151 and a second manual safety lever 161. The first manual safety lever 151 includes a first lever portion 152 and a first connection portion 154 that extends transversely from the first lever portion 152. The first manual safety lever 151 also includes a blocking lever 155 that extends from the first connection portion 154. In the embodiment shown, the blocking lever 155 extends substantially parallel with respect to the first lever portion 152 of the first manual safety lever 151, and the blocking lever 155 also extends substantially parallel to the second lever portion 162 of the second manual safety lever 161. Additionally, in the embodiment shown, the first lever portion 152 and the second lever portion 162 each have a length that is greater than the length of the blocking lever 155.

Figure 4:
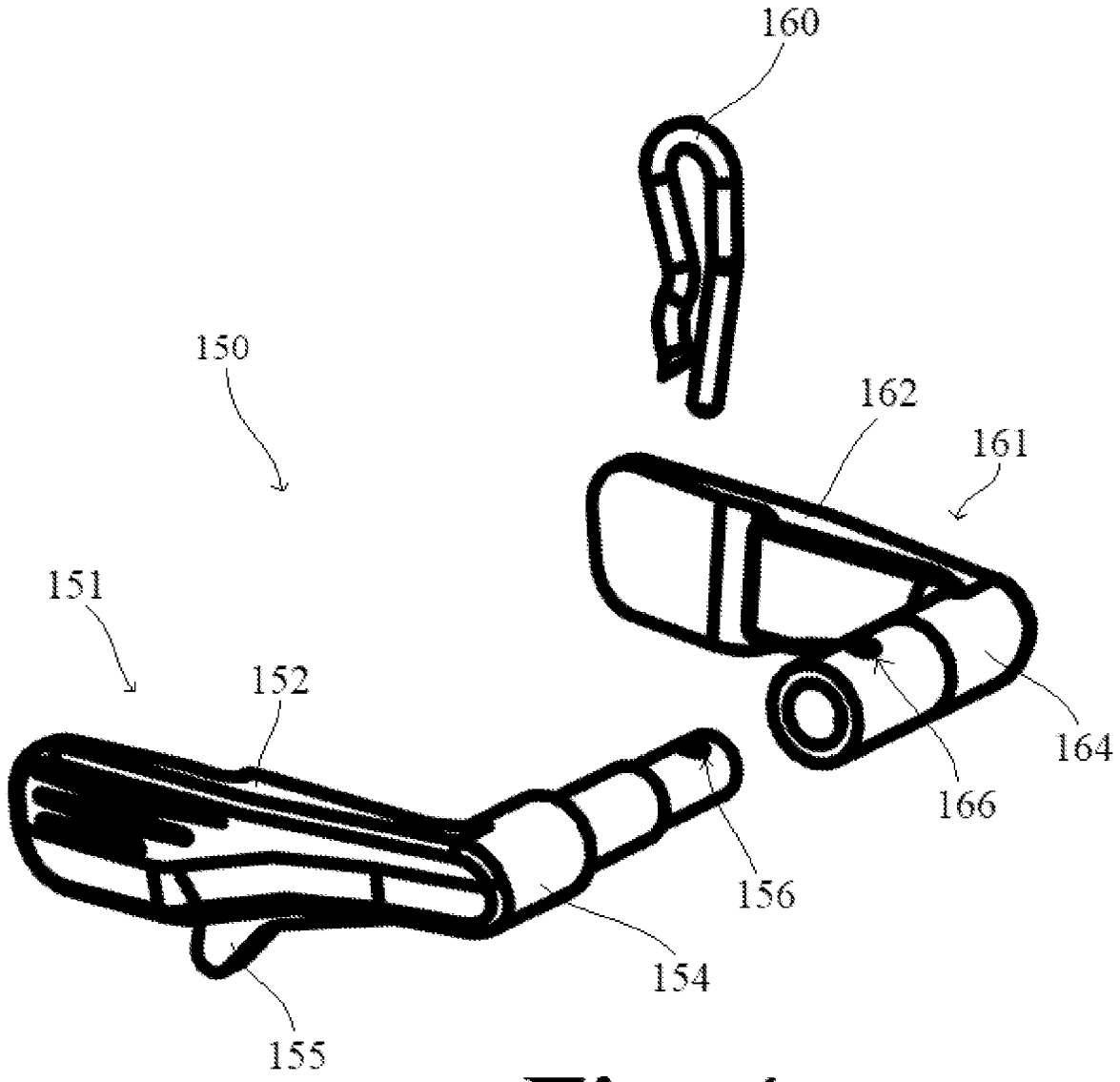
FIG. 4 is a disassembled view of the manual safety assembly of FIG. 3.

Although the blocking lever 155 is parallel to the first manual safety lever 151 in the embodiment shown in FIGS. 3 and 4, the blocking lever 155 is not rotationally aligned with the first lever portion 152 in this embodiment. As illustrated in FIG. 4, the blocking lever 155 extends from the first connection portion 154 so that the blocking lever 155 is positioned so that the bottom edge of the blocking lever 155 is positioned lower than the bottom edge of the first lever portion 152 of the first manual safety lever 151.

The second manual safety lever 161 includes a second lever portion 162 and a second connection portion 164 that extends transversely from the second lever portion 162. The first connection portion 154 of the first manual safety lever 151 is connectable to the second connection portion 164 of the second manual safety lever 161. As shown in FIG. 4, a first connection opening 156 extends through the first connection portion 154 and a corresponding second connection opening 166 extends through the second connection portion 164. A part of the first connection portion 154 may be inserted into a part of the second connection portion 164 so that the connection openings 156, 166 align. A manual safety connector 160 may be inserted through the aligned connection openings 156, 166 to secure the first manual safety lever 151 to the second manual safety lever 161. In other embodiments, other suitable attachment mechanisms may be used. For example, the first connection portion 154 may be connected to the second connection portion 164 by a friction fit or with a tab mechanism.

Figure 5:
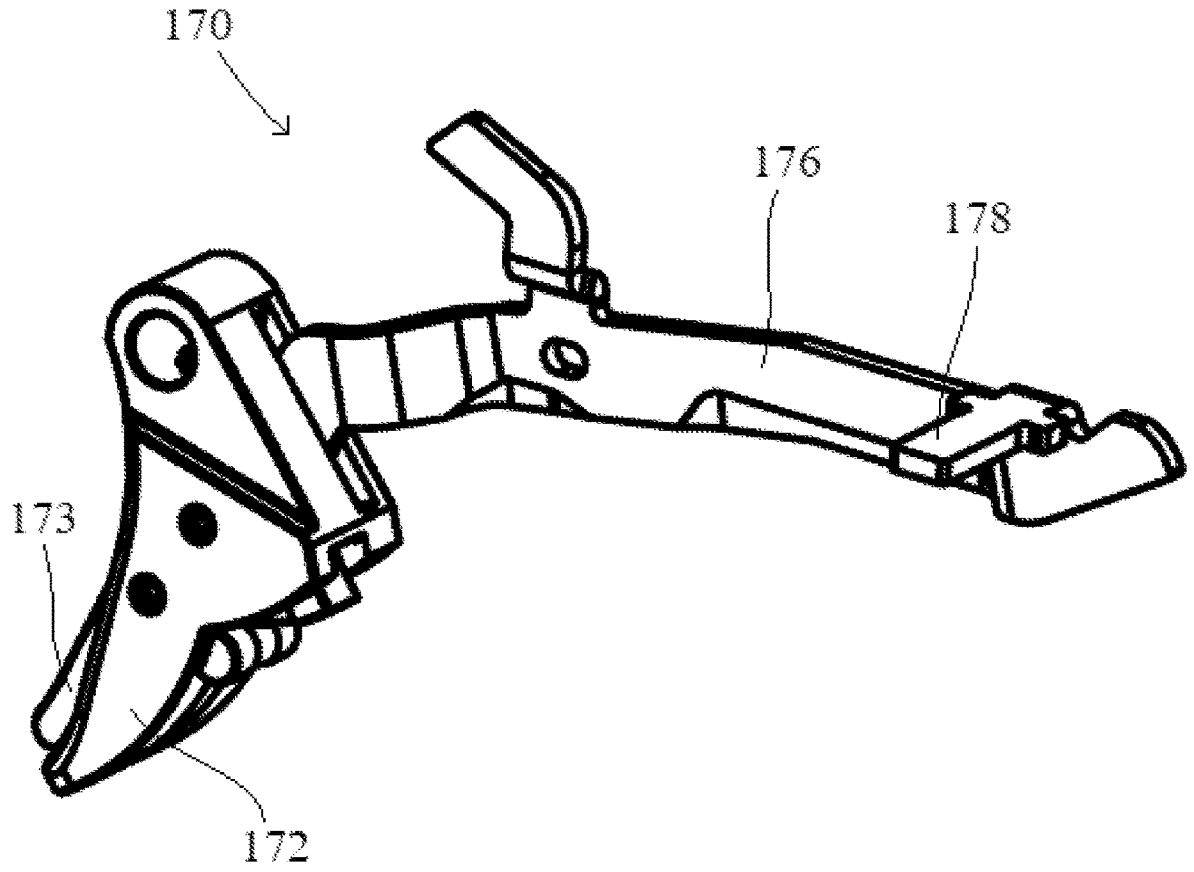
FIG. 5 is a perspective view of a trigger assembly of the firearm of FIG. 1.

The trigger assembly 170 is illustrated in FIG. 5. In the embodiment shown, the trigger assembly 170 includes a trigger 172 and a safety trigger 173 to form a dual trigger arrangement. In other embodiments, the trigger assembly may only include a single trigger. The trigger 172 is operationally connected to the trigger bar 176. The trigger bar 176 extends reward with respect to the trigger 172. A trigger bar extension 178 extends substantially perpendicular from the trigger bar 176 near the rearward end of the trigger bar 176.

Figure 6:
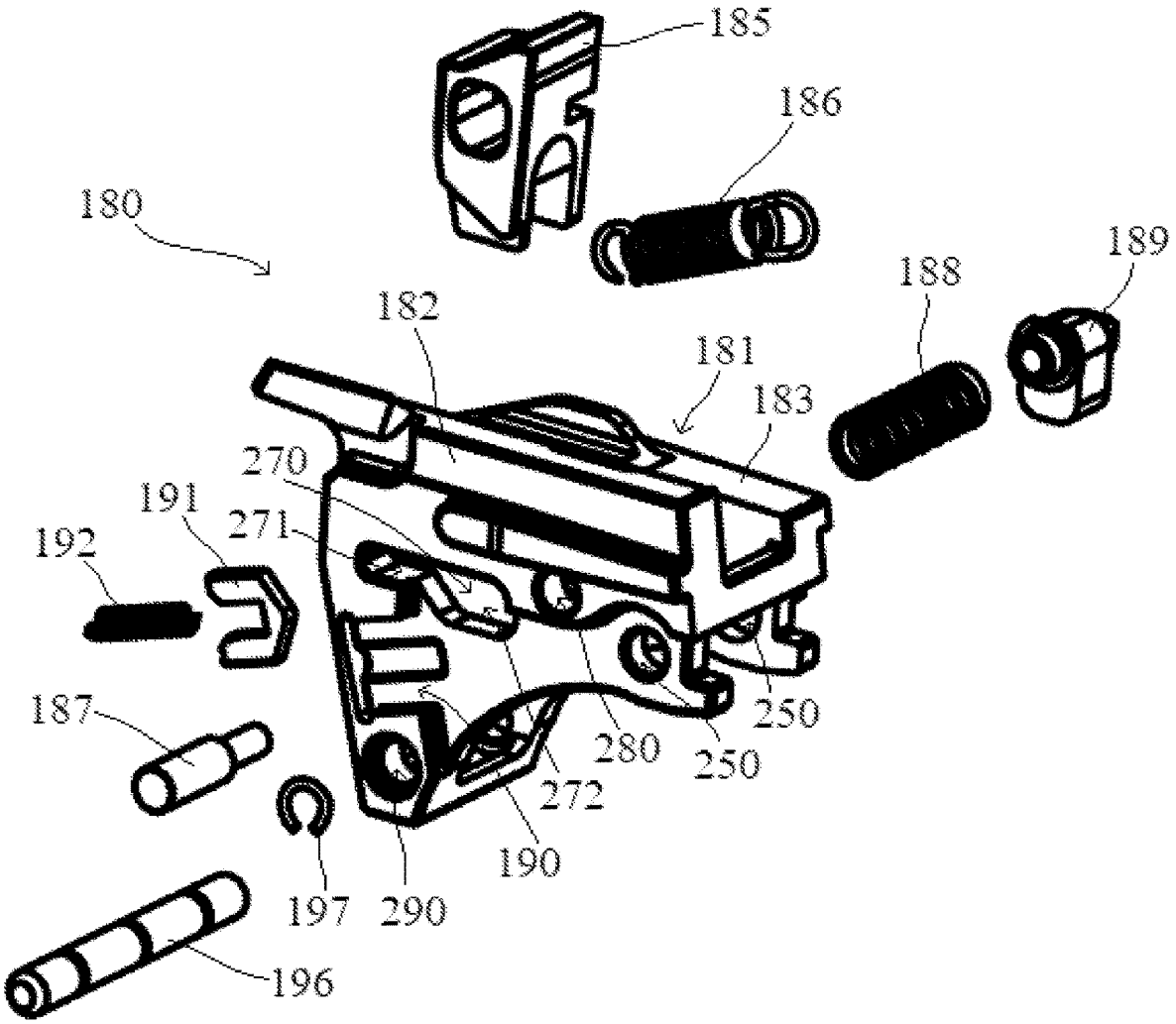
FIG. 6 is a disassembled view of a sear assembly of the firearm of FIG. 1.

The sear assembly 180 is shown in FIG. 6. The sear assembly 180 includes a sear housing 181. The sear housing includes two parallel rails 182, 183 with an opening defined between the parallel rails 182, 183 that is sized so that the sear 185 may fit between the rails 182, 183. A sear spring 186 is also fit into this opening and is attachable to the sear 185. The sear housing 181 also defines several openings so the other components may be connected to or extend through the sear housing 181. A trigger bar opening 270 is defined through each of the rails 182, 183 at a forward portion of the sear housing 181. The trigger bar openings 270 are configured to receive the trigger bar extension 178. The trigger bar opening 270 includes a ledge opening 271 and an expanded firing opening 272. A disconnector opening 280 is defined through each of the rails 182, 183 at a medial portion of the sear housing 181. A manual safety opening 250 is defined through each of the rails 182, 183 at a rearward portion of the sear housing 181. Each of the manual safety openings 250 are configured to receive a corresponding connection portion 154, 164 of the manual safety assembly 150. A sear housing opening 290 is defined through each of the rails 182, 183 at a bottom portion of the sear housing 181.

A disconnector pin 187 may be inserted through the disconnector opening 280 in the sear housing 181. A disconnector spring 188 may be positioned between the rails of the sear housing 181 and surround at least a portion of the disconnector pin 187. An end of the disconnector pin 187 is connected to a disconnector 189 which is positioned on the exterior of the sear housing 181. The sear assembly 180 also includes a recess 190 defined partially in a side wall of the sear housing 181. A manual safety positioner 191 may be fit within the recess 190, and a manual safety spring 192 may be attached to the sear housing 181 at one end and the manual safety positioner 191 at the other end to act as a bias for the manual safety positioner 191. The sear assembly 180 further includes a sear housing pin 196 that is configured to fit through the sear housing opening 290 of the sear housing 181. A sear housing pin safety 197 fits around the sear housing pin 196.

Figure 7:
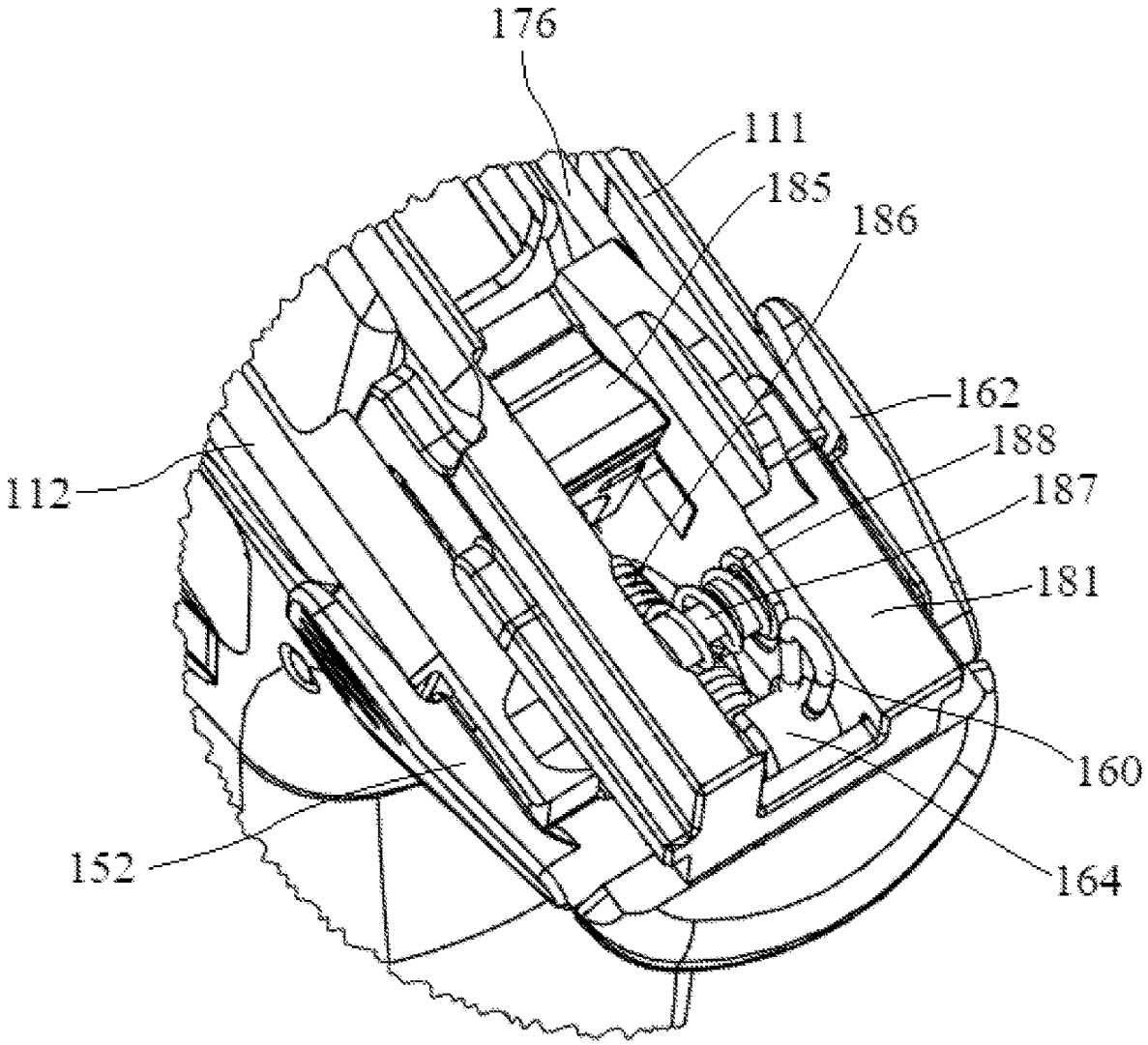
FIG. 7 is a view of the rearward end of the frame of FIG. 2.

FIG. 7 shows a zoomed view of the interior of the frame 110 from FIG. 2 so that it is easier to see how the manual safety assembly 150 fits within the frame. As shown, the manual safety assembly 150 is supported by the sear housing 181 and is positioned rearward of the sear 185 and disconnector pin 187 and disconnector spring 188. The first connection portion 154 of the manual safety assembly 150 extends through an opening defined in the sear housing 181 and the second connection portion 164 extends through a corresponding opening defined through the opposing side of the sear housing 181. The first lever portion 152 of the manual safety assembly 150 is positioned exterior of a side wall of the sear housing 181 and the second lever portion 162 is positioned exterior to the opposite side wall of the sear housing 181.

Figure 8:
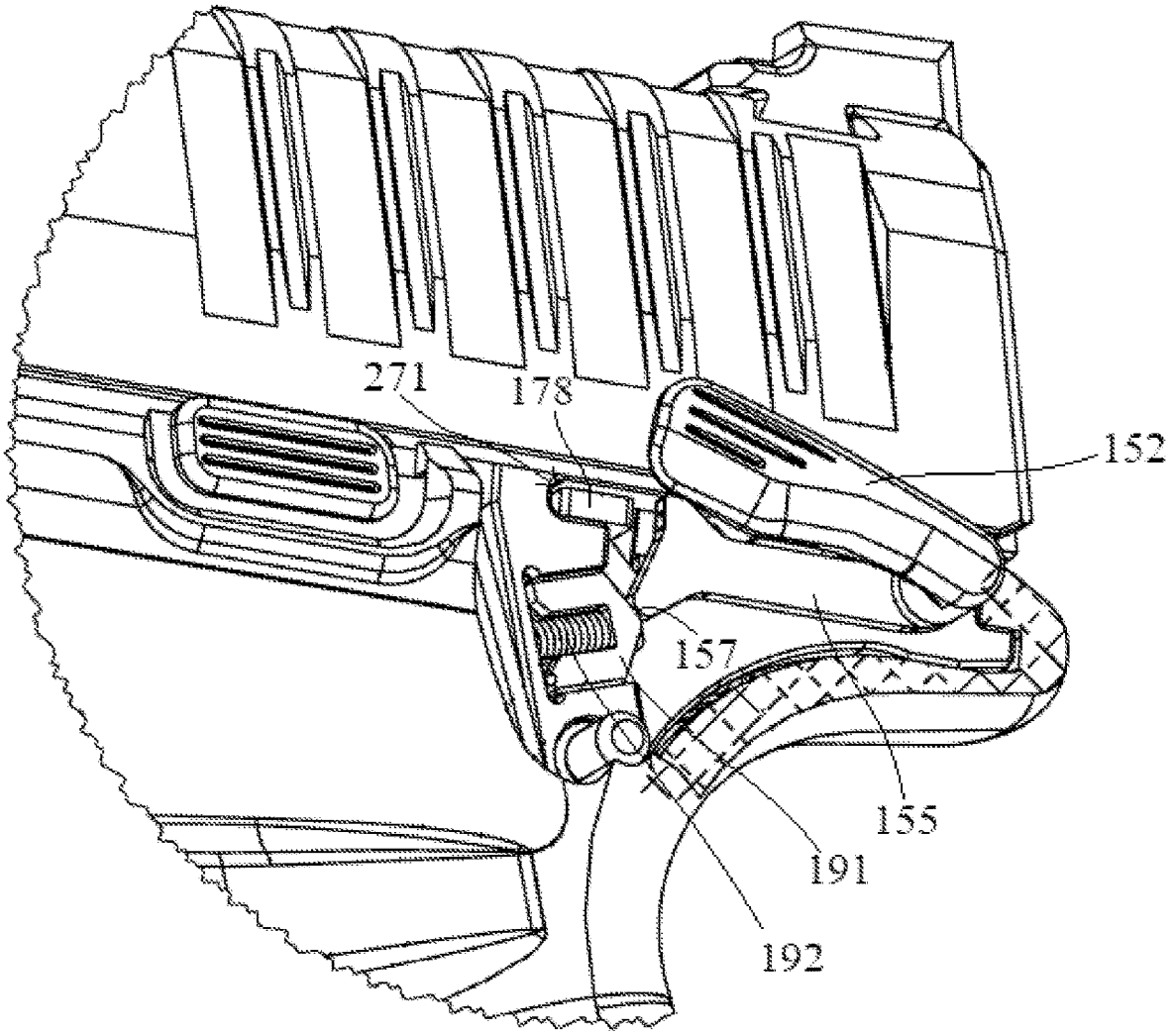
FIG. 8 is a side view of the firearm of FIG. 1 with the manual safety assembly in an engaged position.
Figure 9:
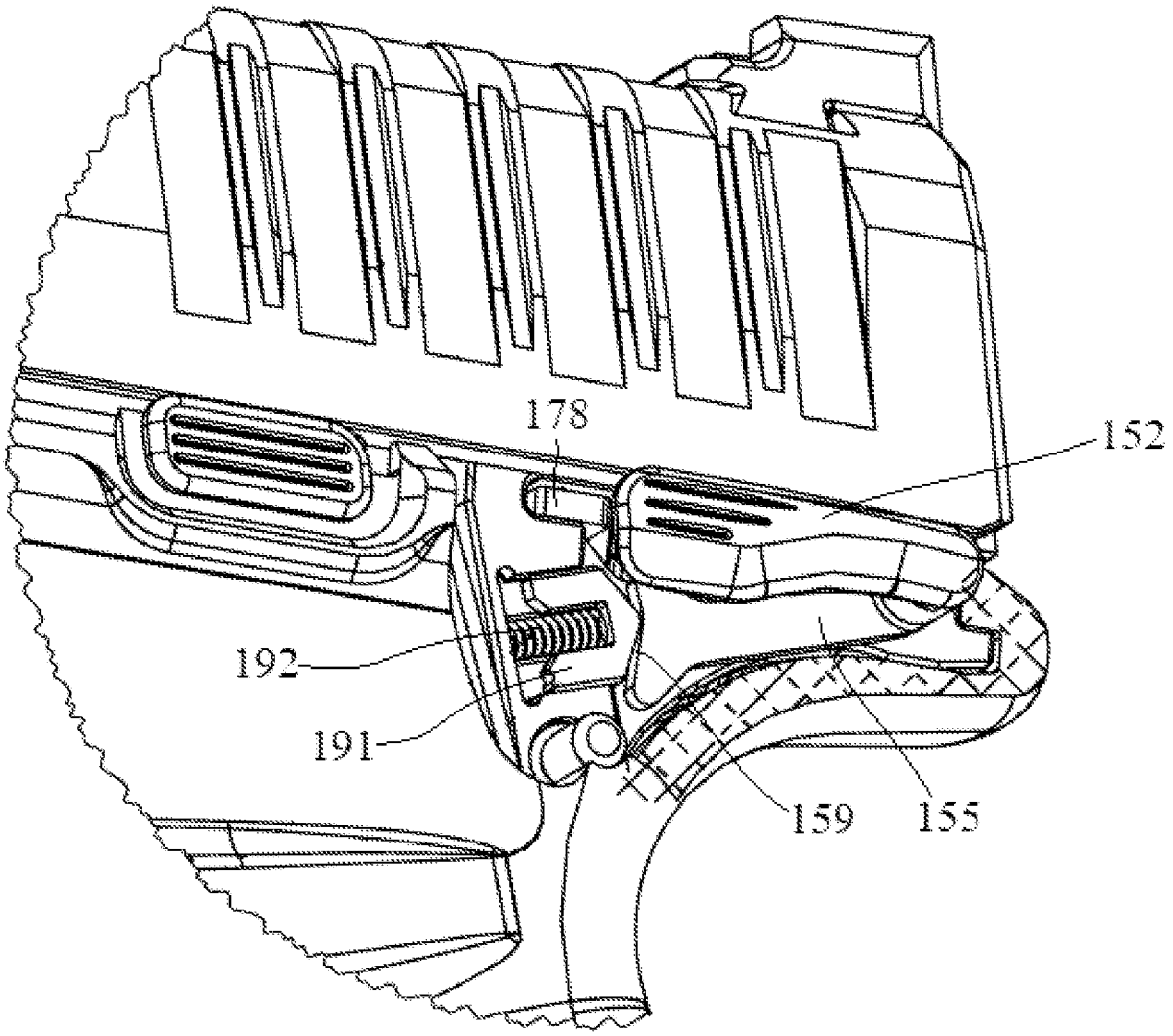
FIG. 9 is a side view of the firearm of FIG. 1 with the manual safety assembly in a disengaged position.
Figure 10:
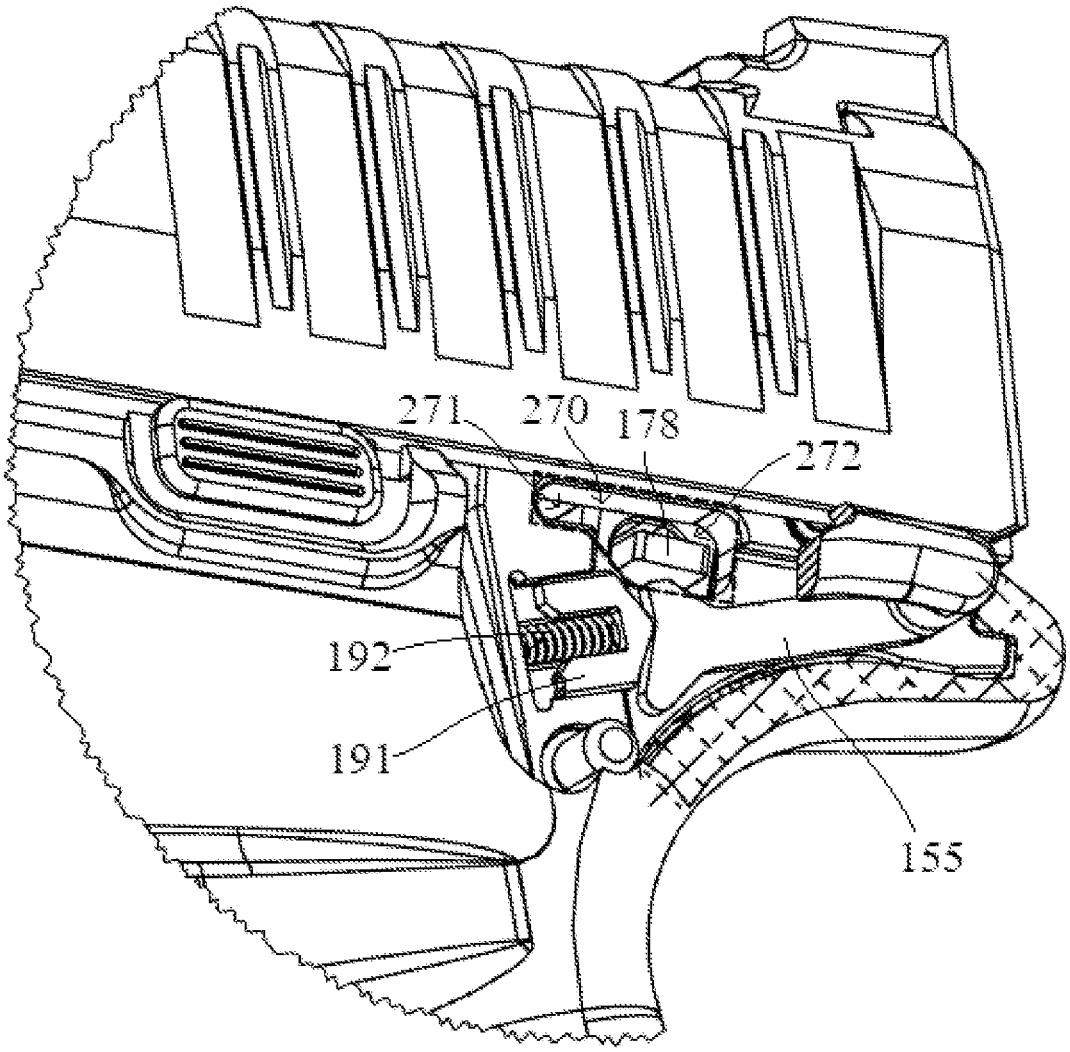
FIG. 10 is the side view shown in FIG. 9 with a portion of the manual safety lever removed to show the position of the blocking lever when the manual safety assembly is configured in the disengaged position.

FIGS. 8-10 illustrate the manual safety assembly 150 in operation. In FIG. 8, the manual safety assembly 150 is arranged in an engaged configuration. In the engaged configuration, the first lever portion 152 of the first manual safety lever 151 is situated in a raised position. Additionally, the manual safety spring 192 is compressed and positions the manual safety positioner 191 so that the manual safety positioner 191 contacts a bottom surface 157 of the blocking lever 155. When arranged in this position, a portion of the blocking lever 155 is directly rearward of the trigger bar extension 178. Therefore, the blocking lever 155 prevents rearward movement of the trigger bar 176 from the ledge portion 271 of the trigger bar opening 270 into the firing portion 272 of the trigger bar opening 270. Not allowing the trigger bar 176 to move rearwardly prevents rotation of the sear 185 that causes a slight rearward and downward movement of the top of the sear as the trigger 172 of the firearm 100 is pulled, and therefore, the shooting cycle of the firearm 100 cannot be completed.

FIG. 9 shows the first manual safety lever 151 arranged in a lowered position so that the manual safety assembly 150 is in a disengaged configuration. FIG. 9 shows the trigger bar 176 in a position before the trigger 172 is pulled, as the trigger bar extension 178 is still located within the ledge portion 271 of the trigger bar opening 270. In the disengaged configuration, the blocking lever 155 is also moved downward upon applying downward force to the first manual safety lever 151 so that the manual safety positioner 191 contacts a front surface 159 of the blocking lever 155 rather than the bottom surface 157. The manual safety positioner 191 holds the blocking lever 155 in this lowered position in which the blocking lever no longer covers the firing portion 272 of the trigger bar opening 270.

FIG. 10 shows the manual safety assembly 150 in the disengaged position and after the trigger 172 has been pulled. In this view, a portion of the first manual safety lever 151 has been removed for ease of illustration. As shown, the trigger bar extension 178 is able to move rearwardly and slightly downward into the firing portion 272 of the trigger bar opening 270 when the trigger 172 is pulled. This rearward movement of the trigger bar extension 178 is allowed when the manual safety assembly 150 is in the disengaged configuration because the blocking lever 155 is moved downward and out of the way of the firing portion 272 of the trigger bar opening 270. The rearward movement of the trigger bar 176 causes rotation of the sear 185 that causes a slight rearward and downward movement of the top of the sear and allows the firearm 100 to fire upon pulling trigger 172.

Because the manual safety levers 151, 161 are interconnected, the manual safety assembly 150 is ambidextrous, so that a user may use either the first manual safety lever 151 or the second manual safety lever 161 to engage or disengage the manual safety assembly 150. To engage the manual safety assembly 150, a user moves either of the manual safety levers 151, 161 upward into the raised position. To disengage the manual safety assembly 150, the user moves either of the manual safety levers 151, 161 downward into the lowered position.

The following numbered clauses set out specific embodiments that may be useful in understanding the present invention:

1. A manual safety assembly comprising:
   a first manual safety lever including a first lever portion and a first connection portion, wherein the first connection portion extends transversely from said first lever portion;
   a second manual safety lever including a second lever portion and a second connection portion, wherein the second connection portion extends transversely from said second lever portion, and wherein said second manual safety lever is connectable to said first manual safety lever;
   a blocking lever, wherein said blocking lever is attached to and extends transversely from said first connection portion of said first manual safety lever; and
   wherein said blocking lever is substantially parallel to said first lever portion.
2. The manual safety assembly of clause 1,
   wherein a first connection opening is defined through said first connection portion of said first manual safety lever; and
   wherein a second connection opening is defined through said second connection portion of said second manual safety lever.
3. The manual safety assembly of any preceding clause, further comprising:
   a manual safety connector; and
   wherein said manual safety connector is configured to be inserted through said first connection opening and said second connection opening when said first connection opening and said second connection opening are aligned to connect said first manual safety lever to said second manual safety lever.

4. The manual safety assembly of any preceding clause, wherein said blocking lever is substantially parallel to said second lever portion of said second manual safety lever.

5. The manual safety assembly of any preceding clause, said first connection portion is fit into said second connection portion to connect said first manual safety lever to said second manual safety lever.

6. The manual safety assembly of any preceding clause, wherein said first lever portion of said first manual safety lever has a length that is greater than a length of the blocking lever.

7. The manual safety assembly of any preceding clause, wherein said blocking lever has a curved bottom surface.

8. A firearm comprising:

a frame including a first sidewall and a second sidewall, wherein a frame interior is defined within said frame;

a slide, wherein said slide is attachable to said frame;

a trigger assembly positioned within said frame interior, wherein said trigger assembly includes a trigger bar, and wherein said trigger bar includes a trigger bar extension that extends substantially perpendicular from a rearward end of said trigger bar;

a manual safety assembly including:

a first manual safety lever including a first lever portion and a first connection portion;

a second manual safety lever including a second lever portion and a second connection portion, wherein said second manual safety lever is removably connectable to said first manual safety lever; and a blocking lever attached to and extending from said first manual safety lever, wherein said blocking lever is substantially parallel to said first lever portion;

wherein said first lever portion of said first manual safety lever is exterior of said first sidewall of said frame, and wherein said second lever portion of said second manual safety lever is exterior of said second sidewall of said frame;

wherein said manual safety assembly has an engaged configuration wherein said blocking lever prevents rearward movement of said trigger bar extension; and wherein said manual safety assembly has a disengaged configuration wherein said blocking lever is positioned to allow rearward movement of said trigger bar extension.

9. The firearm of clause 8, further comprising:

a sear assembly positioned within said frame interior, wherein the sear assembly includes a sear housing and a sear supported by said sear housing.

10. The firearm of any one of clause 8 or 9, wherein first and second manual safety openings are defined through said sear housing;

wherein said first connection portion of said manual safety assembly is fit through said first manual safety opening; and wherein said second connection portion of said manual safety assembly is fit through said second manual safety opening.

11. The firearm of any one of clauses 8-10, further comprising:

a manual safety positioner coupled to said sear housing;

a manual safety spring, wherein a first end of the manual safety spring is attached to said manual safety positioner and a second end of said manual safety spring is attached to said sear housing; and wherein the manual safety positioner is configured to be in direct contact with said blocking lever.

12. The firearm of clause 11, wherein when said manual safety assembly is in the engaged configuration, said manual safety positioner is in contact with a bottom surface of said blocking lever.

13. The firearm of clause 12, wherein said manual safety spring is compressed when said manual safety assembly is in the engaged configuration.

14. The firearm of clause 11, wherein when said manual safety assembly is in the disengaged configuration, said manual safety positioner is in contact with a front surface of said blocking lever.

15. The firearm of clause 11, wherein the manual safety positioner and said manual safety spring are fit within a recess defined in said sear housing.

16. The firearm of clause 9, wherein the trigger bar extension extends through a trigger bar opening defined through the sear housing.

17. The firearm of any one of clauses 8-16, wherein in the engaged configuration, said first manual safety lever and said second manual safety lever are arranged in a raised position.

18. The firearm of any one of clauses 8-17, wherein in the disengaged configuration, said first manual safety lever and said second manual safety lever are arranged in a lowered position.

19. The firearm of any one of clauses 8-18, wherein said blocking lever is positioned within said frame interior.

20. The firearm of any one of clauses 8-19, wherein when said first manual safety lever and said second manual safety lever are connected, rotation of either safety lever is configured to cause said blocking lever to rotate.

While the invention has been illustrated and described in detail in the drawings and foregoing description, the same is to be considered as illustrative and not restrictive in character, it being understood that only the preferred embodiment has been shown and described and that all changes, equivalents, and modifications that come within the spirit of the inventions defined by following claims are desired to be protected. All publications, patents, and patent applications cited in this specification are herein incorporated by reference as if each individual publication, patent, or patent application were specifically and individually indicated to be incorporated by reference and set forth in its entirety herein.

The invention claimed is:

1. A manual safety assembly comprising:

a first manual safety lever including a first lever portion and a first connection portion, wherein the first connection portion extends transversely from said first lever portion;

a second manual safety lever including a second lever portion and a second connection portion, wherein the second connection portion extends transversely from said second lever portion, and wherein said second manual safety lever is connectable to said first manual safety lever;

a blocking lever, wherein said blocking lever is attached to and extends transversely from and forward with respect to said first connection portion of said first manual safety lever; and wherein said blocking lever is substantially parallel to said first lever portion.

2. The manual safety assembly of claim 1, wherein a first connection opening is defined through said first connection portion of said first manual safety lever; and wherein a second connection opening is defined through said second connection portion of said second manual safety lever.

3. The manual safety assembly of claim 2, further comprising:

a manual safety connector; and wherein said manual safety connector is configured to be inserted through said first connection opening and said second connection opening when said first connection opening and said second connection opening are aligned to connect said first manual safety lever to said second manual safety lever.

4. The manual safety assembly of claim 1, wherein said blocking lever is substantially parallel to said second lever portion of said second manual safety lever.

5. The manual safety assembly of claim 1, said first connection portion is fit into said second connection portion to connect said first manual safety lever to said second manual safety lever.

6. The manual safety assembly of claim 1, wherein said first lever portion of said first manual safety lever has a length that is greater than a length of the blocking lever.

7. The manual safety assembly of claim 1, wherein said blocking lever has a curved bottom surface.

8. A firearm comprising:

a frame including a first sidewall and a second sidewall, wherein a frame interior is defined within said frame;

a slide, wherein said slide is attachable to said frame;

a trigger assembly positioned within said frame interior, wherein said trigger assembly includes a trigger bar, and wherein said trigger bar includes a trigger bar extension that extends substantially perpendicular from a rearward end of said trigger bar;

a manual safety assembly including:

a first manual safety lever including a first lever portion and a first connection portion;

a second manual safety lever including a second lever portion and a second connection portion, wherein said second manual safety lever is removably connectable to said first manual safety lever; and a blocking lever attached to and extending from said first manual safety lever, wherein said blocking lever is substantially parallel to said first lever portion;

wherein said first lever portion of said first manual safety lever is exterior of said first sidewall of said frame, and wherein said second lever portion of said second manual safety lever is exterior of said second sidewall of said frame;

wherein said manual safety assembly has an engaged configuration wherein said blocking lever prevents rearward movement of said trigger bar extension; and wherein said manual safety assembly has a disengaged configuration wherein said blocking lever is positioned to allow rearward movement of said trigger bar extension.

9. The firearm of claim 8, further comprising:

a sear assembly positioned within said frame interior, wherein the sear assembly includes a sear housing and a sear supported by said sear housing.

10. The firearm of claim 9, wherein first and second manual safety openings are defined through said sear housing;

wherein said first connection portion of said manual safety assembly is fit through said first manual safety opening; and wherein said second connection portion of said manual safety assembly is fit through said second manual safety opening.

11. The firearm of claim 9, further comprising:

a manual safety positioner coupled to said sear housing;

a manual safety spring, wherein a first end of the manual safety spring is attached to said manual safety positioner and a second end of said manual safety spring is attached to said sear housing; and wherein the manual safety positioner is configured to be in direct contact with said blocking lever.

12. The firearm of claim 11, wherein when said manual safety assembly is in the engaged configuration, said manual safety positioner is in contact with a bottom surface of said blocking lever.

13. The firearm of claim 12, wherein said manual safety spring is compressed when said manual safety assembly is in the engaged configuration.

14. The firearm of claim 11, wherein when said manual safety assembly is in the disengaged configuration, said manual safety positioner is in contact with a front surface of said blocking lever.

15. The firearm of claim 11, wherein the manual safety positioner and said manual safety spring are fit within a recess defined in said sear housing.

16. The firearm of claim 9, wherein the trigger bar extension extends through a trigger bar opening defined through the sear housing.

17. The firearm of claim 8, wherein in the engaged configuration, said first manual safety lever and said second manual safety lever are arranged in a raised position.

18. The firearm of claim 8, wherein in the disengaged configuration, said first manual safety lever and said second manual safety lever are arranged in a lowered position.

19. The firearm of claim 8, wherein said blocking lever is positioned within said frame interior.

20. The firearm of claim 8, wherein when said first manual safety lever and said second manual safety lever are connected, rotation of either safety lever is configured to cause said blocking lever to rotate.

* * * * *